US012527442B2

(12) United States Patent
Skrabis

(10) Patent No.: US 12,527,442 B2
(45) Date of Patent: Jan. 20, 2026

(54) BATH AND SHOWER CADDY ASSEMBLY

(71) Applicant: Patricia Skrabis, Nashville, TN (US)

(72) Inventor: Patricia Skrabis, Nashville, TN (US)

( * ) Notice: Subject to any disclaimer, the term of this patent is extended or adjusted under 35 U.S.C. 154(b) by 279 days.

(21) Appl. No.: 18/170,398

(22) Filed: Feb. 16, 2023

(65) Prior Publication Data

US 2023/0337867 A1 Oct. 26, 2023

Related U.S. Application Data

(60) Provisional application No. 63/310,900, filed on Feb. 16, 2022.

(51) Int. Cl.
*A47K 3/28* (2006.01)
*A47K 5/02* (2006.01)

(52) U.S. Cl.
CPC ..... *A47K 3/281* (2013.01); *A47K 5/02* (2013.01); *A47K 2201/025* (2013.01)

(58) Field of Classification Search
CPC .... A47K 3/281; A47K 5/02; A47K 2201/025; A47K 1/09; A47K 5/18; A47B 73/00; A47B 73/004; A47B 73/006; A47B 73/008
USPC ..... 211/119.009, 89.01, 75, 106, 119.004, 211/119.011, 88.03, 74; 248/311.2
See application file for complete search history.

(56) References Cited

U.S. PATENT DOCUMENTS 2,336,224 A * 12/1943 Cohen ..... A47K 1/09 211/75
2,428,073 A * 9/1947 Handel ..... A47J 47/16 248/224.7
2,763,377 A * 9/1956 Martin ..... A47J 47/16 211/75
3,643,813 A * 2/1972 Noonan ..... A47B 73/00 211/75
3,750,890 A * 8/1973 Smith ..... A47G 29/08 248/309.2
4,088,250 A * 5/1978 Schaefer ..... A45F 5/00 224/558
4,106,736 A * 8/1978 Becker, III ..... A47F 5/01 248/302
4,205,620 A * 6/1980 Keys ..... G09F 11/02 211/75
4,372,450 A * 2/1983 Licari ..... A47G 25/0678 211/32
4,573,591 A * 3/1986 Chap ..... A47K 3/281 211/113
4,721,276 A * 1/1988 Moss ..... B60N 3/10 248/205.2
5,000,124 A * 3/1991 Bergen ..... A01K 5/0114 248/295.11
5,255,401 A * 10/1993 Sambrookes ..... A47K 3/281 211/112

(Continued)

*Primary Examiner* — Jennifer E. Novosad
(74) *Attorney, Agent, or Firm* — Taylor Duma LLP

(57) ABSTRACT

A bath and shower caddy assembly for holding a container, including a frame assembly having a pair of vertical side bars and at least one cross bar, a female assembly disposed on the cross bar, the female assembly including a front wall portion and a back wall portion defining a slot, and a bottle holder assembly including a continuous side wall defining a bore to receive a portion of the container herein, and a male assembly including a lock plate is slideably receivable within the slot of the female assembly.

13 Claims, 13 Drawing Sheets

(56) References Cited

U.S. PATENT DOCUMENTS 5,464,183 A * 11/1995 McConnell ..... B62B 9/26 224/407
5,947,322 A * 9/1999 Ho ..... B65F 1/1607 220/477
6,279,760 B1 * 8/2001 Broeski ..... A47J 47/16 211/74
6,637,707 B1 * 10/2003 Gates ..... A47B 96/061 248/222.12
6,808,090 B2 * 10/2004 Pedersen ..... B65D 25/22 248/205.5
7,275,729 B2 * 10/2007 Sherman ..... A47L 13/51 248/311.2
7,422,184 B2 * 9/2008 Carnevali ..... B60N 3/103 248/314
D608,054 S * 1/2010 Radfar ..... D6/567
7,931,161 B2 * 4/2011 Newbould ..... A47B 55/02 211/181.1
8,186,521 B2 * 5/2012 Yu ..... A47F 5/13 211/90.03
8,256,639 B1 * 9/2012 Samuelson ..... A01K 7/00 220/574
8,439,209 B2 * 5/2013 Strollo ..... A47B 81/00 211/75
8,573,416 B2 * 11/2013 Didehvar ..... A47K 3/281 211/119.009
8,819,876 B2 * 9/2014 Dabrowski ..... A47K 3/281 211/119.011
8,833,596 B2 * 9/2014 Sanguinet ..... B65D 25/22 211/74
9,681,781 B2 * 6/2017 Hurley ..... A47F 5/0876
10,390,616 B2 * 8/2019 Schaefer ..... A47F 7/0071
2003/0197104 A1 * 10/2003 Heybl ..... B60N 3/108 248/314
2004/0021048 A1 * 2/2004 Schaal ..... B60N 3/108 248/311.2
2004/0099624 A1 * 5/2004 Hein ..... A47L 13/512 211/89.01
2009/0145866 A1 * 6/2009 Panosian ..... A47F 5/0838 211/85.15
2014/0158848 A1 * 6/2014 Caruso ..... B60N 3/108 248/311.2
2014/0284293 A1 * 9/2014 Greco ..... A47K 3/281 211/85.12
2023/0337867 A1 * 10/2023 Skrabis ..... A47K 3/281

* cited by examiner

BATH AND SHOWER CADDY ASSEMBLY

This application claims priority to U.S. Provisional Application No. 63/310,900, filed Feb. 16, 2022, the entire disclosure of which is incorporated by reference herein.

TECHNICAL FIELD OF THE INVENTION

The technical field of this invention relates in general to devices used to store and dispense items in a bathroom setting and, more particularly, to store and dispense personal hygiene products in a shower or tub.

BACKGROUND OF THE INVENTION

Bathroom and shower caddies have been around for years. However, most caddies suffer from the same problems; bottles (shampoo, soap, conditioner, lotion, body rinse, etc.) typically sit in an upright position making it difficult to empty contents from the original container. Users must shake the bottles vigorously, water down the contents, or simply throw the remaining contents away—wasting money. As well, large, heavy and/or tall bottles may easily fall over the rails of existing caddies or cause the caddy to tilt and become unbalanced, often resulting in bottles falling to the shower floor. Also, small personal items, such as razors, small tubes of oils, creams, gels, and bar soaps, fall through the bars/shelving of traditional caddy systems presenting a safety hazard as these items can be stepped on or cause the user to slip on them and fall.

Efforts have been made to address or solve the 'inverted bottle' issue, albeit with minimal success as these proposed solutions often present other problems and potential hazards. Frequently, they also do not address the issue of small items falling through the bars/shelving. Those shower caddies that attempt to address the 'inverted bottle' issue do not accommodate multiple bottles of various shapes and sizes in a secure, neat, and orderly manner. Frequently, those solutions either require users to permanently attach an apparatus to the shower wall and manually empty bottle contents into a corresponding container as needed, or users must empty the contents in a hanging solution into a chamber of a bottle holder, and then press that chamber to dispense the contents. Some attempted solutions allow for bottles to be stored mostly in an inverse position, and require the user to remove the bottle from the device to open it and dispense the contents each use. These attempts are often messy, time consuming, and fall short of solving the original problems.

Another proposed solution is made of silicone or rubber that is hung by a cord and supports an object in the shower, but only accommodates a single bottle. The apparatus in question 'dangles' the corresponding bottle and does not allow for any non-bottled items to be stored, such as: razors, bar soaps, and/or small tubes of product (i.e., hot oils, jells, conditioners, etc.), cans of shaving cream, etc. In order to accommodate multiple bottles, the user must have multiple cords hanging from an object or objects in the shower, such as a shower head or faucet handle. Also, to insert bottles, they are forced into a rubber-like material, which uses friction to hold the bottle in place. This action is not usually a smooth insert and removal process of the bottle from the holder solution.

Yet another prior art device is made of a silicone or a rubber like material, and also only allows for a single bottle to be inserted into the chamber/pocket with the contents squeezed into a "dispenser bulb" which the user then has to squeeze to actually dispense the contents. Users cannot dispense the contents directly from the original bottle, and the cap from the bottle must be removed before inserting the bottle into the chamber/pocket, making it difficult and messy to insert the bottle. This device also does not address non-bottled items, such as razors, bar soaps, and/or small tubes of product (i.e., hot oils, jells, conditioners, etc.), cans of shaving cream, etc. Also, the silicone or rubber materials may weaken over time with the stretching and forcing of the bottles both into and out of the device, reducing the ability to grip and retain the corresponding bottle.

Other prior art devices do not allow the solution to be stored securely and neatly in the shower but, rather, they must be placed in a corner of the bathtub or shower floor. These devices do not allow the user to empty the contents directly from the bottle without removing the bottle from the bottle holder and then replacing the bottle back into the bottle holder once they have dispensed some of the contents from the original bottle.

Known prior art devices do not allow the user to configure the storage options based on the user's preference, allow for easy cleaning, securely hold bottles in place and allow storage device to be moved to another location without unloading the bottles and small items, allow secure storage of small hygiene items, or allow the direct access of fluids/bottle contents without emptying into a separate container, or remove the bottle from the devise each time they need to dispense product.

The present invention recognizes and addresses the above, as well as other, considerations of prior art as to constructions and methods.

SUMMARY OF THE INVENTION

The present invention allows users to store most named brand soaps, shampoos, conditioners, lotions, and the like, regardless of bottle shape or size, in an inverse position, easily, securely, without force, and without the need to empty contents into a separate chamber or remove the cap before inserting, which is messy and waste product. Also, it will allow users to dispense the bottle's contents from the original bottle. For some embodiments, the user simply inserts a bottle into the bottle holder, opens the cap directly from the bottom of the bottle holder and dispenses the contents with a squeeze of the bottle, as all fluids will naturally flow downwardly. When contents are completely used up, the user simply pulls the bottle out and inserts a fresh new bottle.

The present invention also facilitates the safe and secure storage of small objects, such as bar soaps, razors, small tubes, cans of shaving cream, etc., by allowing them to be placed securely into a non-opening insert. Also, because the upside-down caddy simply slips over the showerhead, in its preferred embodiment, and does not need to be permanently attached to the shower wall or tied with a string/cord to a shower attachment, it can be readily removed and moved to another location without removing the bottles or other sundries as they will not fall over or out like in some prior art devices as they are securely in place in their respective holders. However, other embodiments of this invention can allow for alternative methods of hanging or attaching the elements other than over a showerhead. For example, alternate embodiments allow for the disclosed caddy to be placed over a shower door or attached through suction cups or the like to the shower wall or door without impeding the functionality of the original embodiment.

The present invention also allows users to customize the caddy by selecting the inserts that best meet their personal care products used. The user may select multiple different inserts which are removable with a push of the lock and release push button and can be easily rinsed off or washed with soap and water. Each bottle holder simply slides back into place and locks for safe, secure storage by sliding the male snap fit lock and release mechanism into the female snap fit. Inserts simply side back into the basic bottle holders.

The accompanying drawings, which are incorporated in and constitute a part of this specification, illustrate one or more embodiments of the invention and, together with the description, serve to explain the principles of the invention.

BRIEF DESCRIPTION OF DRAWINGS

A full and enabling disclosure of the present invention, including the best mode thereof, directed to one of ordinary skill in the art, is set forth in the specification, which makes reference to the appended drawings, in which.

Figure 1:
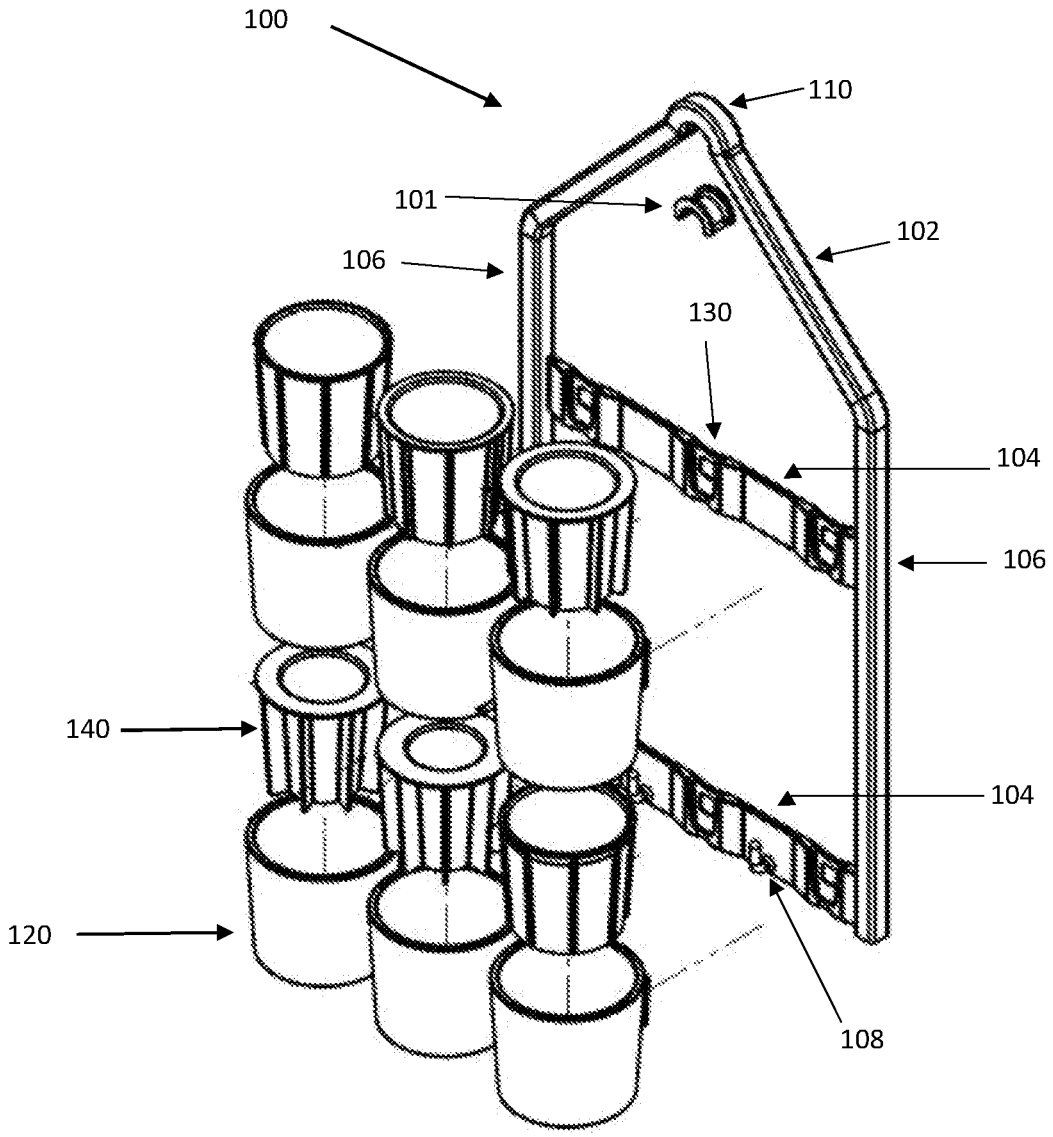
FIG. 1 is a perspective exploded view of a bath and shower caddy assembly in accordance with an embodiment of the present disclosure.
Figure 2A:
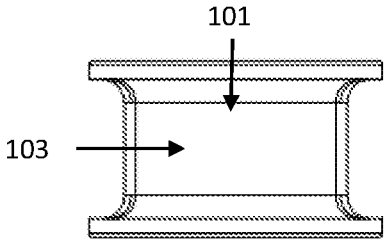
FIGS. 2A through 2F show multiple views of a frame insert of the bath and shower caddy assembly shown in FIG. 1.
Figure 2B:
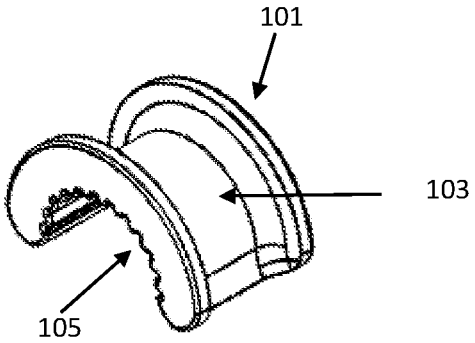
Figure 2C:
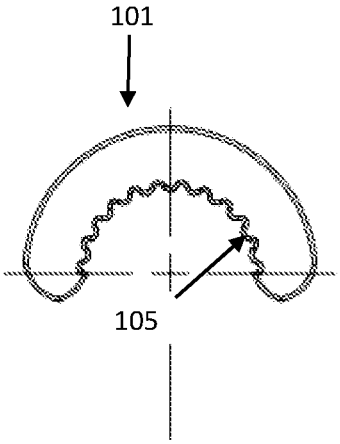
Figure 2D:
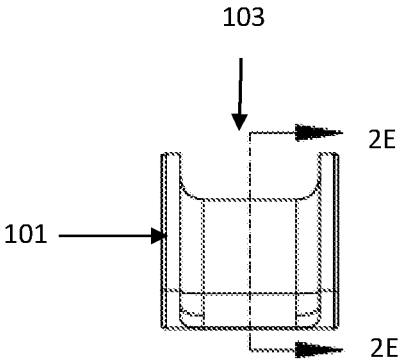
Figure 2E:
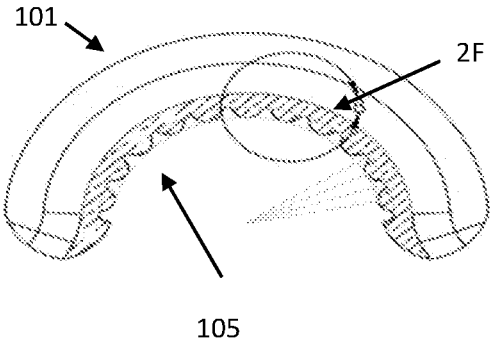
Figure 2F:
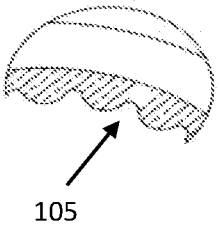

Repeat use of reference characters in the present specification and drawings is intended to represent same or analogous features or elements of the invention according to the disclosure.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the figures, the current invention includes a bath and shower caddy assembly 100 having six bottle holder assemblies 120 that can be used as-is for large sized bottles or can accept any of the various insert assemblies 140 that are made to slide into the bottle holder assemblies 120 for the purpose of storing variously sized bottles or other such containers. The bottles and containers are stored in an inverse position for the purpose of easily dispensing thick fluids in their totality depending on the size and shape of bottles. As well, non-open inserts are provided for storing small personal hygiene items such as, tubes, razors, bar soaps, etc.; and other cans or bottles that are not suited the open-bottom bottle holder insert assemblies 140 as they would pass through and fall to the ground. The bath and shower caddy assembly 100 is designed to slip over a showerhead neck (not shown) and hold firmly into place with a silicone frame insert 101 to help balance the caddy assembly 100. However, those skilled in the art may choose to use other means to attach the caddy assembly 100, for example, over a shower door, or suctioned to the shower wall or doors. The bottle holder assemblies 120 may be easily removed from the top and bottom cross bars 104 of the frame assembly 102 in the event user wants to rinse or wash them, and replaced by utilizing the snap-fit mechanism as described in greater detail below. The frame assembly 102 is shown as one piece, but based on manufacturer's preference, can be produced in parts and assembled. The frame assembly 102 and all its respective parts, and the bottle holder assemblies 120, including the male snap-fit lock assemblies 122, and insert assemblies 140, can be made of plastic, chrome, stainless steel, aluminum, copper, bronze, brass or other materials those skilled in the art may choose.

FIG. 1 shows the preferred embodiment of the caddy assembly 100 which includes the frame assembly 102, which is shown as one piece, and may be made to accommodate more or fewer bottle holder assemblies 120. As shown, the frame assembly 102 includes left and right side bars 106 that curve at the top 110 to fit over the neck of a shower head (not shown), top and bottom cross bars 104, each with three female snap-fit assemblies 130. The caddy assembly 100 also includes the silicone frame insert 101 and six bottle holder assemblies 120, each with a built-in male snap fit-lock assembly 122, shown with various embodiments of the insert assemblies 140 designed to be received in the bottle holder assemblies 120. Preferably, the bottom cross bar 104 contains two hooks 108 for hanging washcloths, etc., however more or fewer hooks 108 can be added.

FIGS. 2A through 2F show several different views of the frame insert 101. In its preferred embodiment, the frame insert 101 is a substantially inverted U-shape and fits over the neck of the showerhead to help stabilize the caddy assembly 100. Someone skilled in the art may choose to manufacture with other rubber-like materials or other stabilizing materials. The top surfaces of the frame insert 101 forms a groove 103 that is configured to receive a corresponding top portion 110 of the frame assembly 102 therein. The bottom surface of the frame insert 101 may include a plurality of proturbances 105 to help grip the surface of the shower head on which it is mounted.

FIGS. 3A through 3H show the frame assembly 102 in an exemplary embodiment of the invention including the left and right side bars 106 and the curved top 110 that goes over the neck of a showerhead. Crossbars 104 extend between the side bars 106 and each cross bar 104 preferably includes three female snap-fit assemblies 130 by which the bottle holder assemblies 120 are connected to the frame assembly 102 by the male snap-fit lock assemblies 122 which slide into and are locked in place by the male snap-fit lock release push button assembly 124, as discussed in greater detail below. Note, the caddy assembly 100 can be manufactured to hold more or fewer bottle holder assemblies 120 than as shown. Also, as noted, the bottom crossbar 104 includes two hooks 108 that can be used to hold items such as, loofahs or washcloths, but can have more or fewer hooks.

Figure 4B:
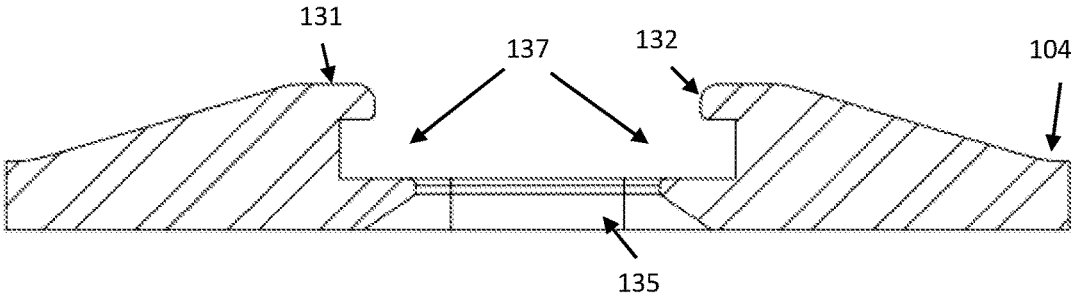
FIGS. 4A through 4C show multiple views of the frame and female snap-fit assemblies of the bar and shower caddy assembly shown in FIG. 1.
Figure 4A:
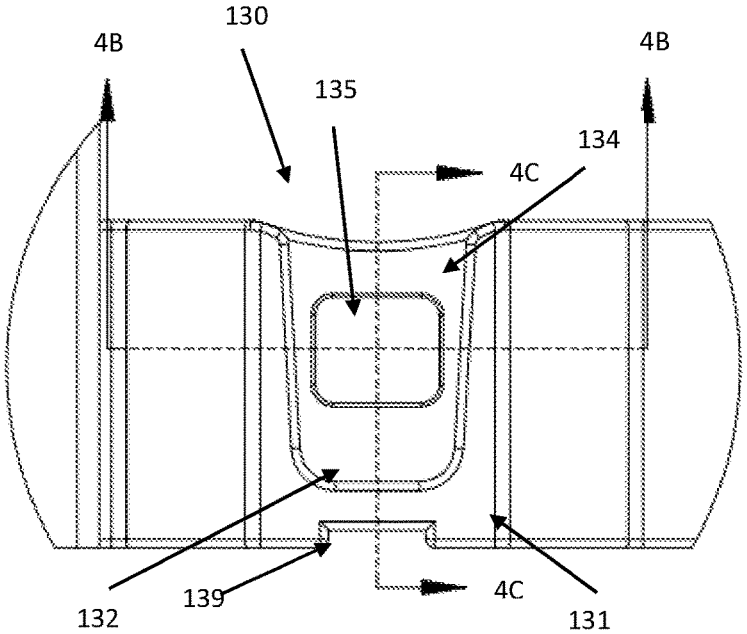
Figure 4C:
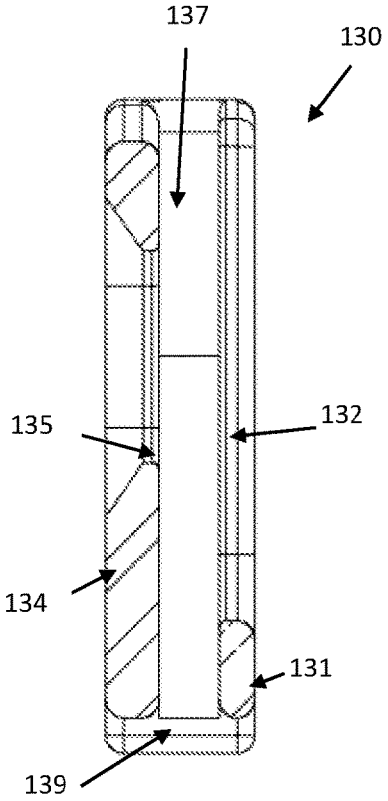

Referring additionally to FIGS. 4A through 4C, each of the female snap-fit assemblies 130 on the crossbars 104 includes a front wall portion 131 with an opening 132 in the front and a back wall portion 133 defining an opening 135 in the back in which the catch 125 on the free end of the release tab 126 of the male snap-fit lock assembly 122 selectively extends. To attach the bottle holder assembly 120 to the frame assembly 102, a lock plate 127 of the male snap-fit assembly 122 bottle holder assembly 120 is slid downwardly into a slot 137 defined between the front and back frame portions 131 and 134 of the female snap-fit assembly 130 until the catch 125 engages the opening 135 in the back wall portion. To remove, a user presses inwardly on the catch 125 until it disengages from the hole 135 and pushes upwardly on the bottle holder assembly 120.

Figure 3A:
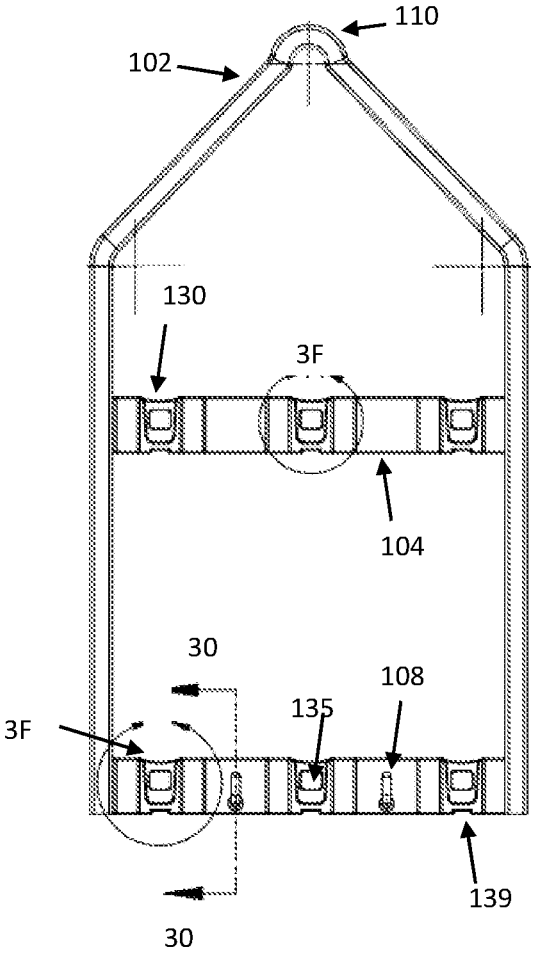
FIGS. 3A through 3H show multiple views of the frame and female snap-fit assemblies of the bath and shower caddy assembly shown in FIG. 1.
Figure 3B:
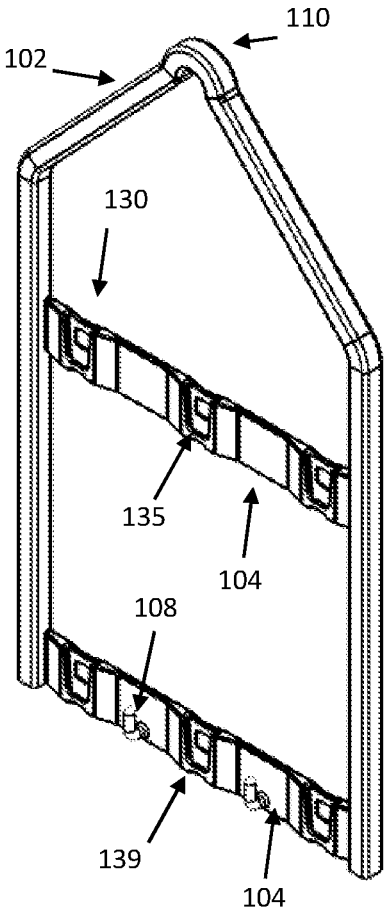
Figure 3C:
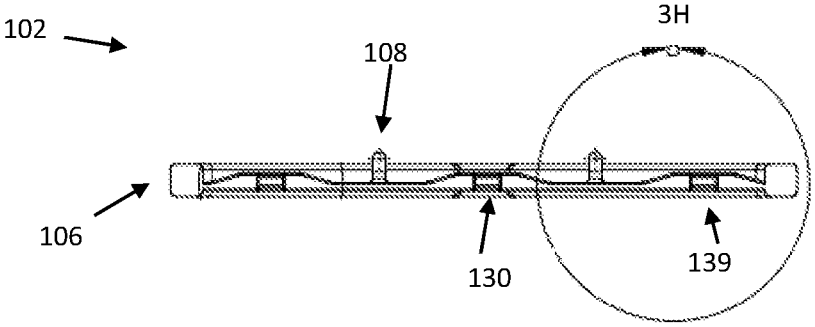
Figure 3D:
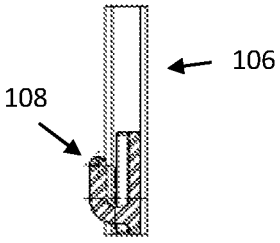
Figure 3E:
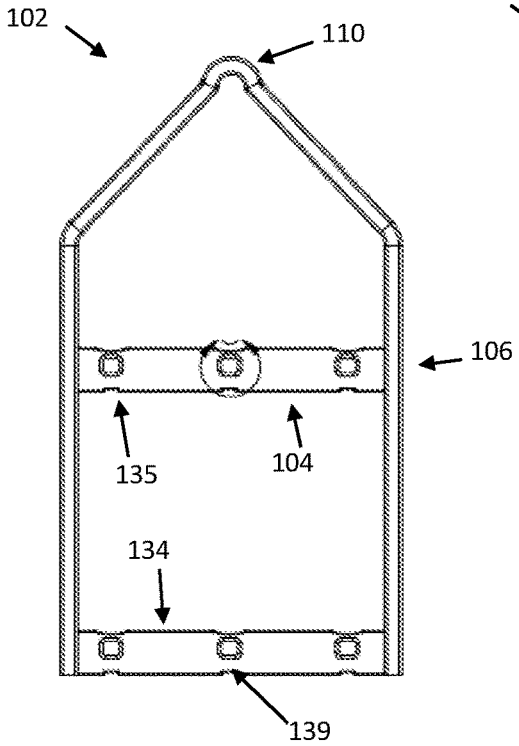
Figure 3F:
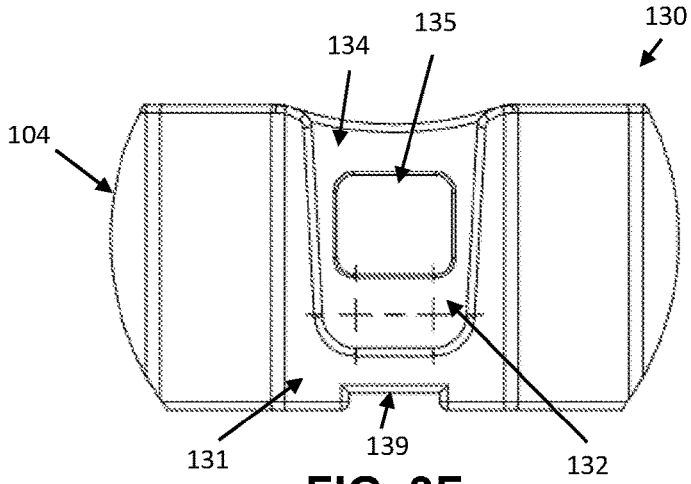
Figure 3G:
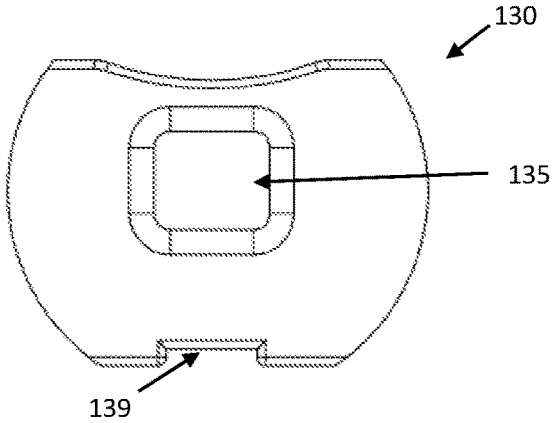
Figure 3H:
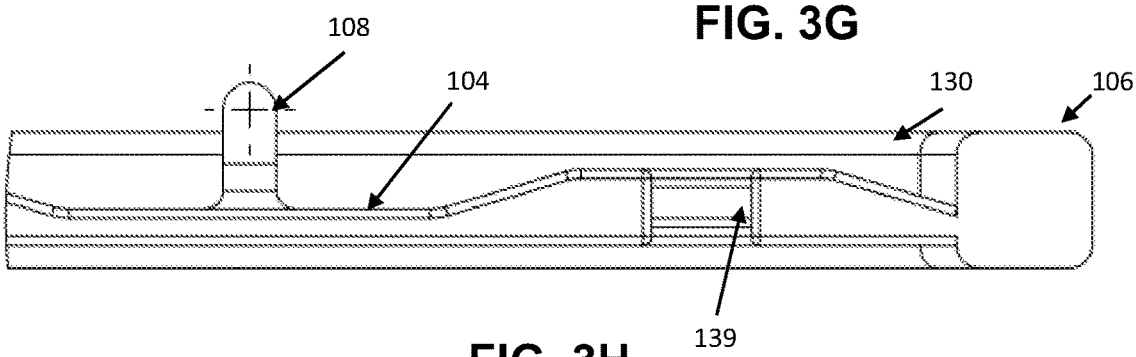

Referring specifically to FIGS. 3E and 3G, a back view of the frame assembly 102 and female snap-fit assembly 130 through the opening 135 that receives the catch 125 of the corresponding male snap-fit lock assembly. FIG. 3F is a zoomed in front view of the female snap-fit assembly 130 on the top crossbar 104 identified in FIG. 3A. The front wall portions 131 of the female snap-fit assemblies 13 are angled and are thicker than the thickness of the top and bottom cross bars 104 to support the weight of the bottle holder assemblies 120 and contents that will be placed therein. The opening 135 in the back wall portion 134 is where the male snap-fit release tab catch 125 locks and the bottom of the female snap-fit assembly 130 contains a drain cut/opening 139 so that water does not collect/pool inside. FIG. 3G is a zoomed in back view of the female snap-fit opening 135 on the top crossbar 104 that the male snap-fit lock catch 125 locks into.

Figure 5A:
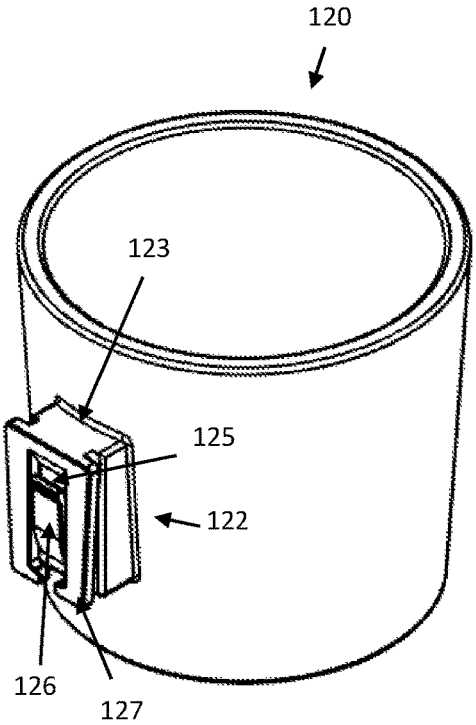
FIGS. 5A through 5H show multiple views of a first embodiment of a bottle holder assembly and corresponding male snap-fit assembly of the bath and shower caddy assembly shown in FIG. 1.
Figure 5B:
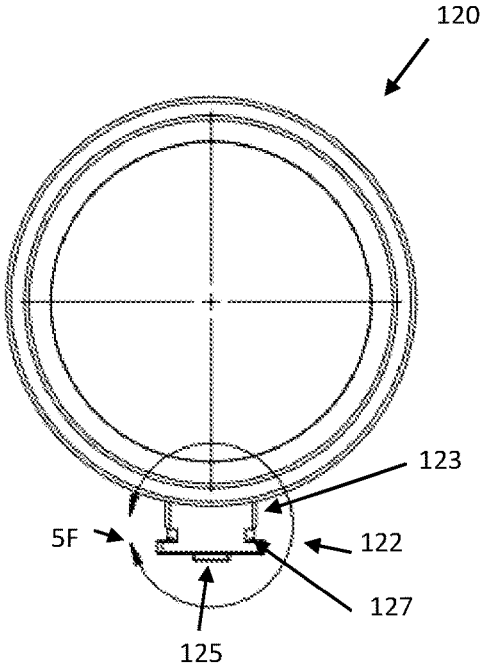
Figure 5C:
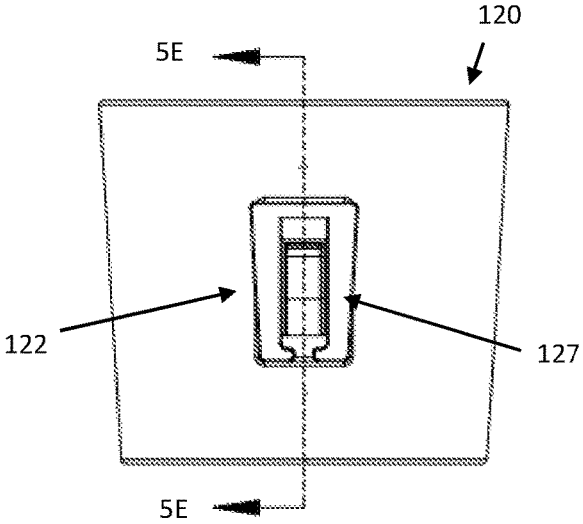
Figure 5D:
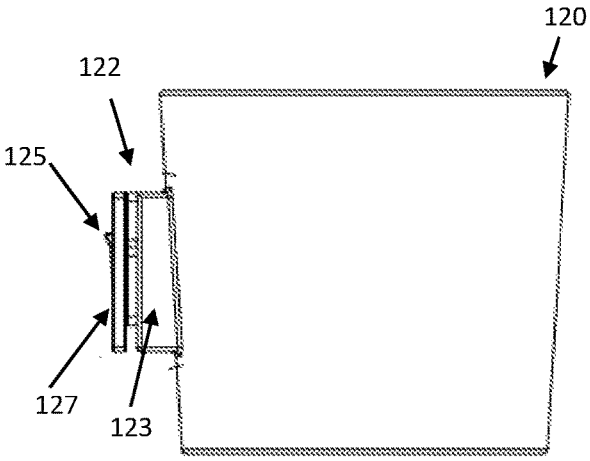
Figure 5E:
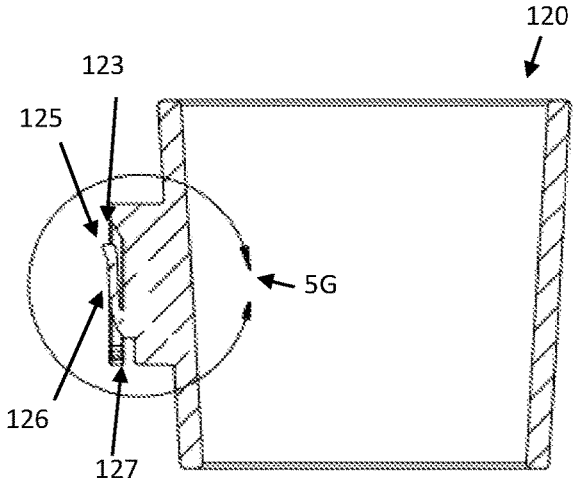
Figure 5F:
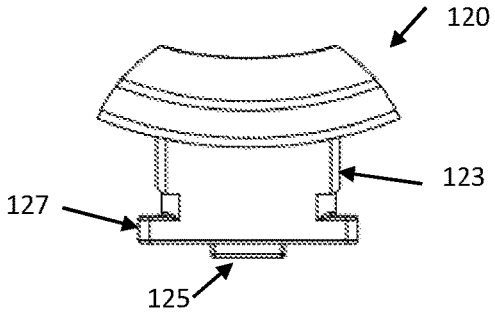
Figure 5G:
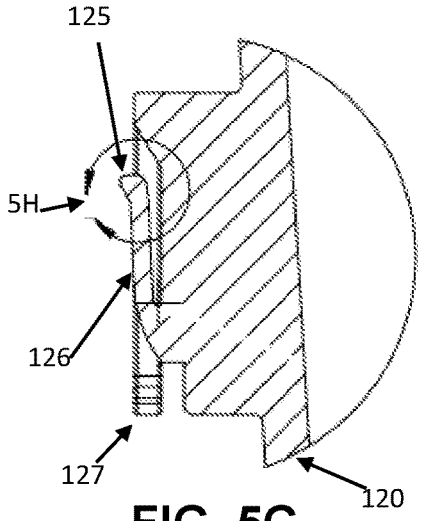
Figure 5H:
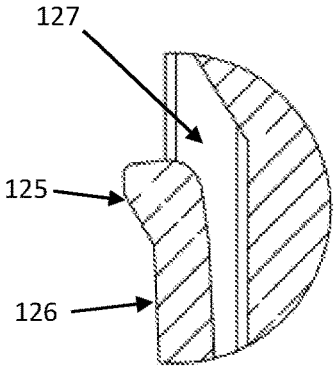

FIGS. 5A and 5H, show various views of an embodiment of a bottle holder assembly 120 in accordance with an example embodiment of the present invention. As shown, the bottle holder assembly 120 includes the male snap-fit lock assembly 122 as a single unit built into the holder. Preferably, the male snap-fit lock assembly 120 includes a support foundation 123, a release push button assembly 124 formed by a flexible release tab 126 having a catch 126, and a lock plate 127 which slides into the slot 139 of the female snap-fit lock 130. As discussed above, users simply slide the lock plate 127 of the male snap-fit lock assembly 122 into the slot 139 of the female snap-fit lock assembly 130 until they hear a click, which indicates the bottle holder assembly 120 is firmly locked into place and is ready to receive bottles or an insert. To remove the bottle holder assembly 120 from the frame 102, users simply push inwardly or the catch 125 of the male snap-fit lock assembly 122 and slide the bottle holder assembly 120 up and out of the female snap-fit lock assembly 130. Alternate embodiments or methods for attaching the bottle holder assembly 120 to the frame 102 may be used in alternate embodiments.

Referring specifically to FIGS. 5E through 5F, details of interior views of the male snap-fit lock assembly 122 are shown. FIG. 5E shows a cross-sentinal view of the interior of the bottle holder assembly 120 and the male snap-fit lock assembly 122, including the release tab 126 and catch 125. FIG. 5F is a zoomed-in top view and FIG. 5G is a zoomed-in view of the interior view of the male snap-fit lock assembly 122, including the release tab 126 and catch 125. FIG. 5H shows a zoomed in view of the flexible release tab 126 and catch 125 used to remove the bottle holder assembly 120 from the female snap-fit assembly 130, according to the illustrative embodiment.

Figure 6A:
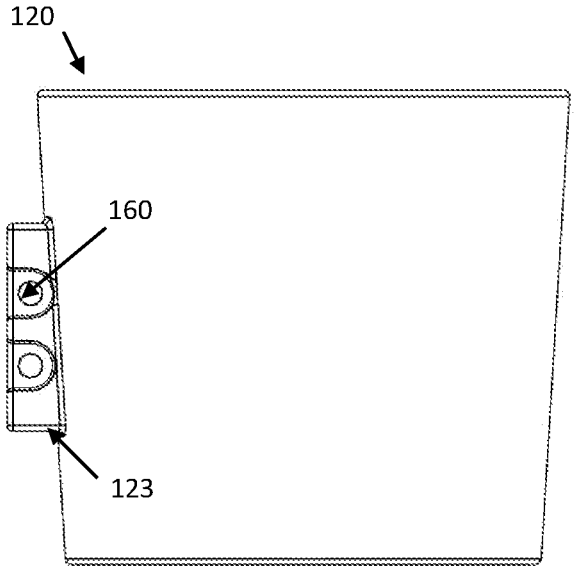
FIGS. 6A through 6D show multiple views of a alternate embodiment of a bottle holder assembly of the shower caddy assembly shown in FIG. 1.
Figure 6B:
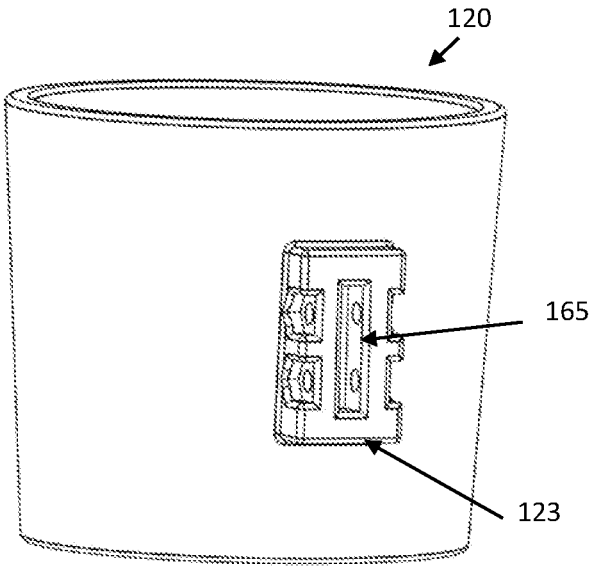
Figure 6C:
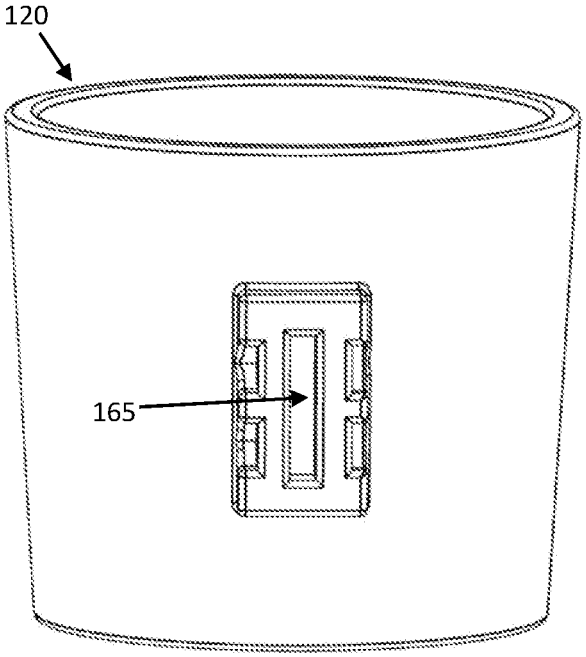
Figure 6D:
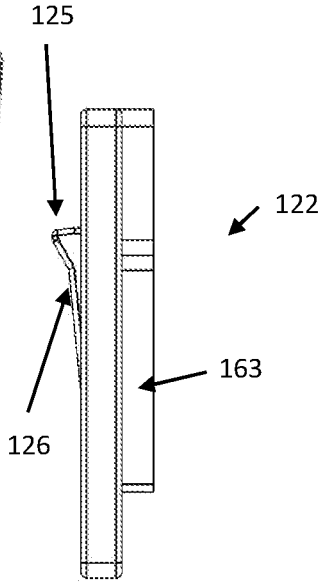
Figure 7A:
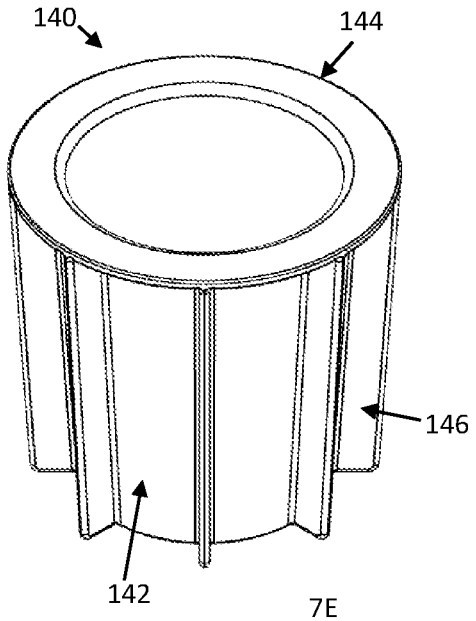
FIGS. 7A through 7G show multiple views of a first embodiment of an insert assembly of the bar and shower caddy assembly shown in FIG. 1.
Figure 7B:
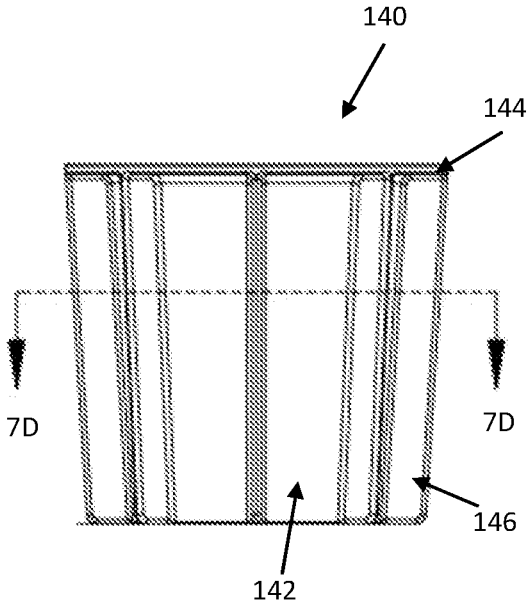
Figure 7C:
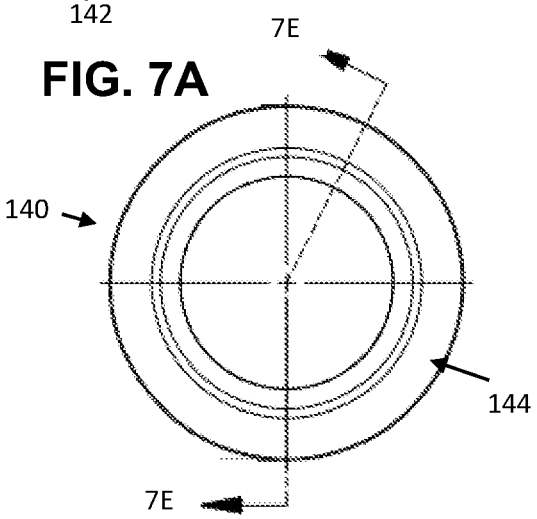
Figure 7D:
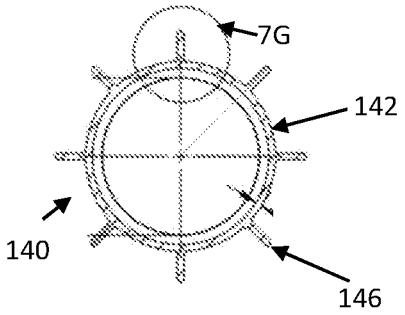
Figure 7E:
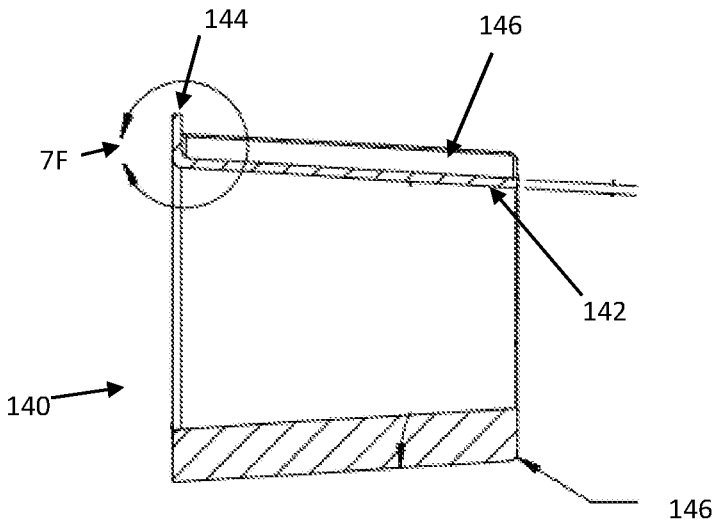
Figure 7F:
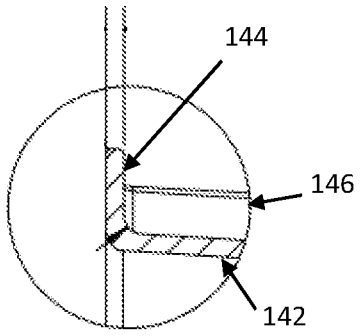
Figure 7G:
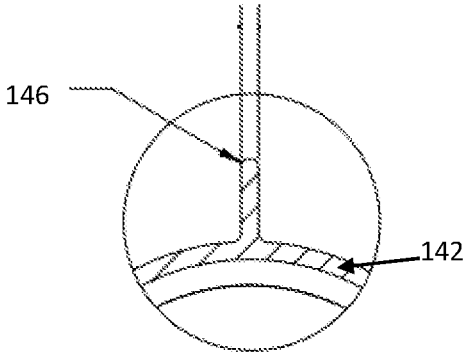
Figure 8A:
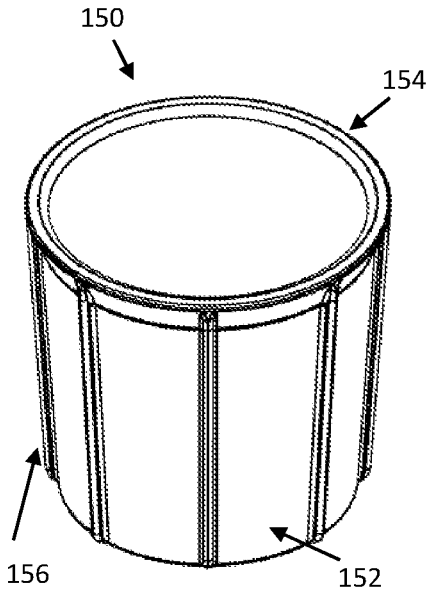
FIGS. 8A through 8E show multiple views of a first embodiment of a non-open insert assembly shown in FIG. 1.
Figure 8B:
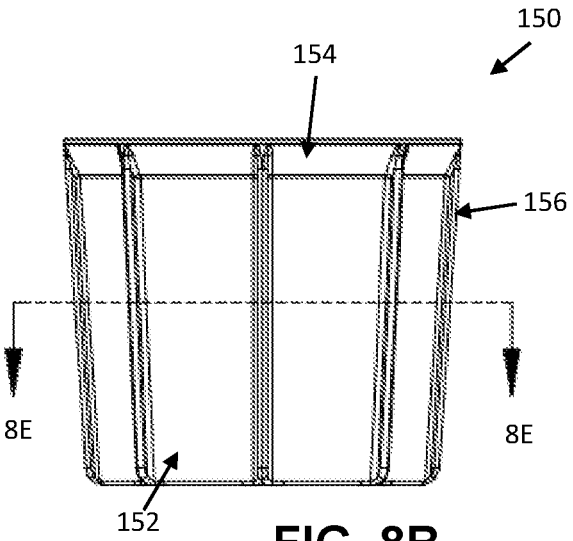
Figure 8C:
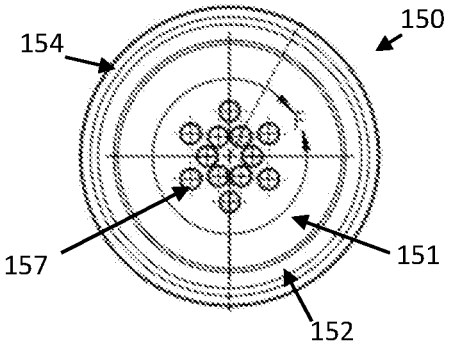
Figure 8D:
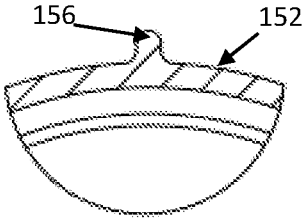
Figure 8E:
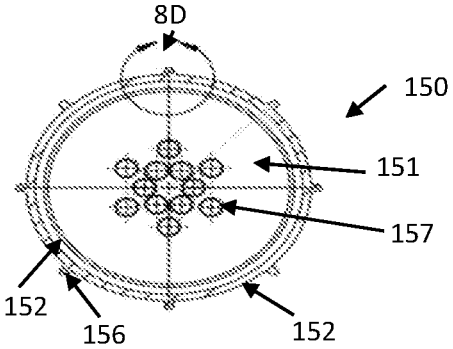

FIGS. 6A through 6D show various views of an alternative embodiment of attaching the male snap-fit lock assembly 122 to the support foundation 123 that is part of the bottle holder assembly 120 in the event, for example, it is desirable to construct the bottle holder assembly 120 in multiple pieces. FIG. 6A shows a side view of the bottle holder assembly 120 and the support foundation 123 of the male snap-fit lock assembly 122. The support foundation 123 contains two holes 160 that are for screws or bolts (not shown) to be placed after the male snap-fit lock assembly 122 is inserted into the foundation 123 to secure it firmly in place. As shown in FIG. 6A, projection 163 is inserted into the slot 165 in the support foundation 123 part shown in FIGS. 6B and 6C. FIG. 6B is a perspective back view showing the four holes (two on either side) in the support foundation 123 that is part of the bottle holder assembly 120. It also shows the vertical rectangular slot 165 that the projection 163 of the release push button assembly 124 is inserted into. Once the projection 163 is inserted into the vertical rectangular slot 165 on the support foundation 123, screws or bolts would then be placed into the two holes and secured in place with nuts adjacent the other two opposite holes, according to the illustrative embodiment.

FIGS. 7A through 7G show various views of an insert assembly 140 for use with the caddy assembly 100. As shown, the insert assembly 140 includes a frustoconically-shaped side wall 142, annular rim 144 extending radially-outwardly therefrom, and a plurality of ribs extending outwardly from the outer surface thereof. The design of the insert assembly 140 includes a taper form controlled by the size of the ribs 146 and rim 144. In the preferred embodiment shown, the bottle holder assemblies 120 are uniformly sized. The top rim 144 and ribs 146 of each insert assembly 140 are configured to extend across the gap between the side wall of the bottle holder assembly 120 and corresponding insert assembly 140. The larger the bottle, the smaller the rim 144 and ribs 146 are. In contrast, the smaller the bottle, the larger the rim 144 and ribs 146 are. All sizes of inserts slide easily into the bottle holder assemblies 120. Note, variously-sized insert assemblies are envisioned in the present embodiment in order to accommodate variously-sized bottle in the shower caddy 100.

FIGS. 8A through 8E show an example embodiment of a non-open insert assembly 150 which is to be used to contain small personal hygiene items, such as bar soaps, razors, small tubes, a can of shaving cream, etc., or bottles that do not fit any of the other inserts or bottle holders. The non-open insert assembly 150 differs primarily from the previously discussed insert assemblies 140 in that the non-open insert assembly 150 includes a bottom wall 151 so that items cannot pass through. Drainage holes 153 are provided in the bottom wall 151 of the non-open insert assembly 150.

Figure 9A:
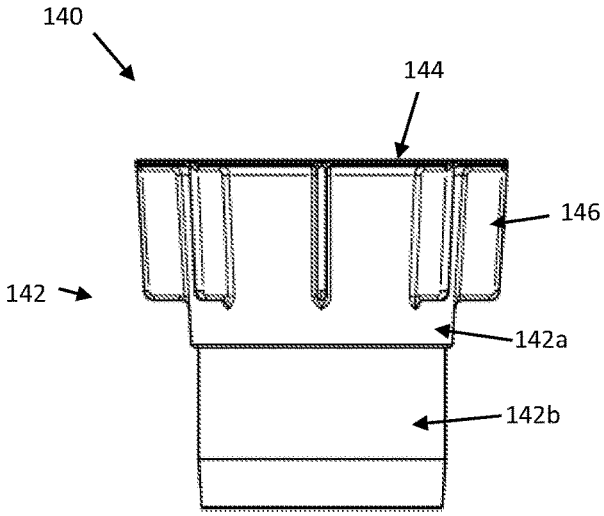
FIGS. 9A through 9D show multiple views of an alternate embodiment of an insert assembly of the bath and shower caddy assembly shown in FIG. 1.
Figure 9B:
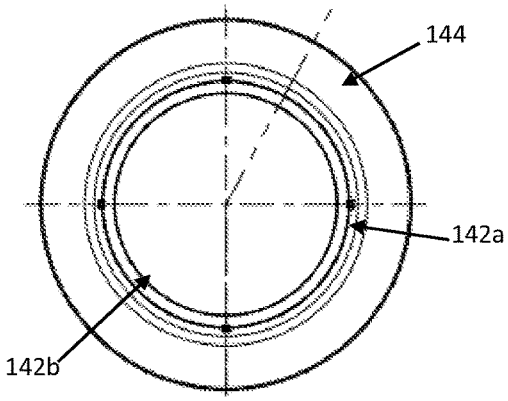
Figure 9C:
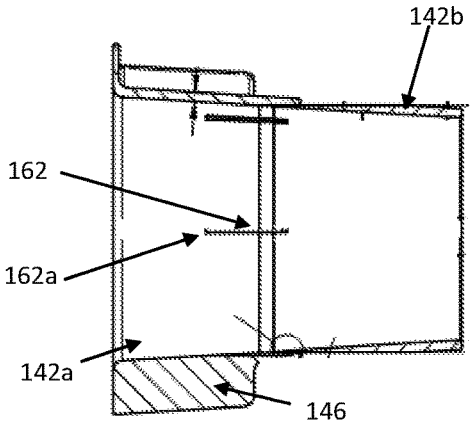
Figure 9D:
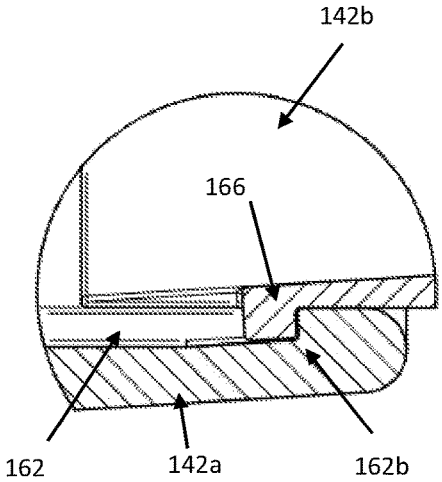

FIGS. 9A through 9D show various views of an insert assembly 140 with a feature that allows for the overall size to be reduced when not in use. This alternate embodiment makes the insert assembly 140 collapsible to decrease the size for shipping and storage purposes. The present insert assembly differs from the earlier discussed versions in that the side wall 142 is formed of an upper portion 142 and a lower portion 142 that is slidably received in the upper portion 142. As best seen in FIGS. 9C and 9D. The upper portion 142 includes a plurality, in the present embodiment four, axially-extending grooves 162, each having an upper stop 162 and a bottom stop 162, formed in its inner surface. Each groove 162 is certified to slidably receive a corresponding radially-outwardly extending tab 166 disposed on an outer surface of the lower portion 142 of the side wall 142. As such, the lower portion 142 may be slidably received within the upper portion 142, if the insert assembly 140 were not in use.

Figure 10A:
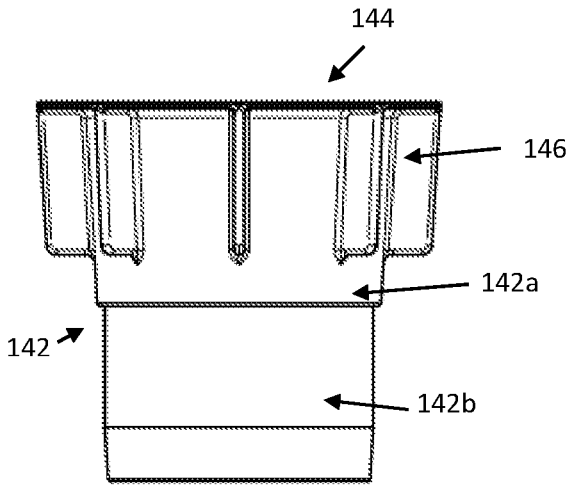
FIGS. 10A through 10F show multiple views of yet another and the alternate embodiment of an insert assembly of the bath and shower caddy assembly shown in FIG. 1.
Figure 10B:
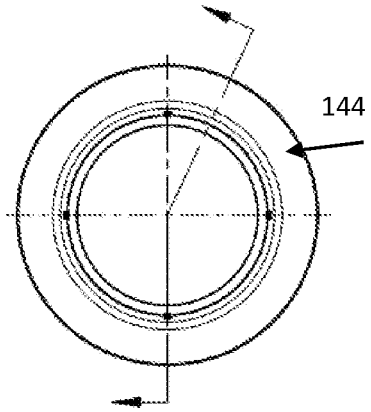
Figure 10C:
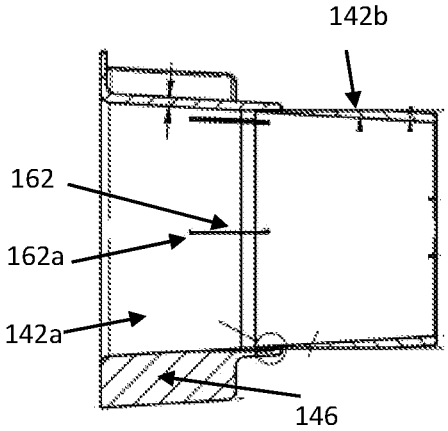
Figure 10D:
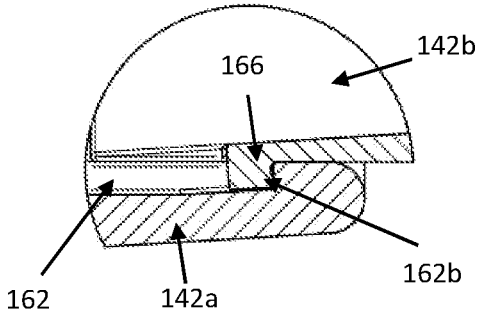
Figure 10E:
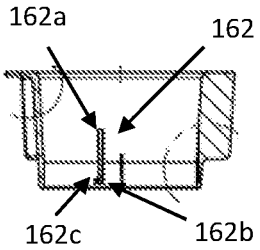
Figure 10F:
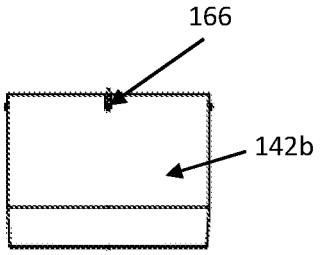

Referring to FIGS. 10A through 10F, another alternate embodiment of an insert assembly 140 is shown. As best seen in FIGS. 10E and 10F, this embodiment differs from the embodiment shown in FIGS. 9A through 9D in that each groove 162 has an additional lock slot 162 extending horizontally from the bottom stop 162. As such, rotating the tabs 166 of the bottom portion 162 will prevent inadvertently collapsing of the insert assembly 140 as the bottom portion must be rotated slightly prior to closing so that each tab 166 is vertically aligned in the groove 162.

The invention claimed is:

1. A bath and shower caddy assembly for holding a container in a vertical position, the caddy assembly comprising:

a frame assembly having a pair of vertical side bars and at least one cross bar extending therebetween;

a female assembly disposed on the at least one cross bar, the female assembly including a front wall portion and a back wall portion that are substantially parallel and define a slot therebetween; and a bottle holder assembly including a continuous side wall defining a bore adapted to receive a portion of the container therein, and a male assembly including a lock plate, wherein the lock plate of the male assembly is slideably receivable within the slot of the female assembly;

wherein:

the female assembly further comprises an opening defined in the back wall of the female assembly; and the male assembly further comprises a flexible release tab including a proximal end affixed to the bottle holder and a deflectable distal end, and a catch extending outwardly from the distal end of the flexible tab, wherein the catch is selectively engageable with the opening in the back wall of the female assembly.

2. The caddy assembly of claim 1, further comprising at least one insert assembly including a continuous side wall, a radially-extending circular rim disposed at a top edge of the side wall, and a plurality of ribs extending radially-outwardly from an outer surface of the continuous side wall of the insert assembly, wherein the insert assembly is slideably receivable within the bore of the bottle holder assembly.

3. The caddy assembly of claim 2, wherein the side wall of the insert assembly is frustoconically shaped and defines a bore configured to receive a portion of the container therein.

4. The caddy assembly of claim 2, wherein the rim and the plurality of ribs extend between the side wall of the insert assembly and the side wall of the bottle holder assembly where the insert assembly is received within the bottle holder assembly.

5. The caddy assembly of claim 2, wherein the at least one insert assembly comprises a plurality of insert assemblies, each insert assembly having a side wall defining a bore of a different diameter.

6. The caddy assembly of claim 2, wherein the at least one insert assembly further comprises a bottom wall disposed at a bottom edge of the side wall.

7. The caddy assembly of claim 6, wherein the bottom wall defines a plurality of drainage openings.

8. A bath and shower caddy assembly for holding a container in a vertical position, the caddy assembly comprising:

a frame assembly having a pair of vertical side bars and at least one cross bar extending therebetween;

a bottle holder assembly including a continuous side wall defining a bore adapted to receive a portion of the container therein;

a female assembly disposed on one of the at least one cross bar of the frame assembly and the bottle holder assembly, the female assembly including a front wall portion and a back wall portion that are substantially parallel and define a slot therebetween; and a male assembly disposed on the other of the at least one cross bar of the frame assembly and the bottle holder assembly, the male assembly including a lock plate, wherein the lock plate of the male assembly is slideably receivable within the slot of the female assembly;

wherein:

the female assembly further comprises an opening defined in the back wall of the female assembly; and the male assembly further comprises a flexible release tab including a proximal end affixed to the bottle holder and a deflectable distal end, and a catch extending outwardly from the distal end of the flexible tab, wherein the catch is selectively engageable with the opening in the back wall of the female assembly.

9. The caddy assembly of claim 8, further comprising at least one insert assembly including a continuous side wall, a radially-extending circular rim disposed at a top edge of the side wall, and a plurality of ribs extending radially-outwardly from an outer surface of the continuous side wall of the insert assembly, wherein the insert assembly is slideably receivable within the bore of the bottle holder assembly.

10. The caddy assembly of claim 9, wherein the side wall of the insert assembly is frustoconically shaped and defines a bore configured to receive a portion of the container therein.

11. The caddy assembly of claim 9, wherein the rim and the plurality of ribs extend between the side wall of the insert assembly and the side wall of the bottle holder assembly where the insert assembly is received within the bottle holder assembly.

12. The caddy assembly of claim 9, wherein the at least one insert assembly comprises a plurality of insert assemblies, each insert assembly having a side wall defining a bore of a different diameter.

13. The caddy assembly of claim 9, wherein the at least one insert assembly further comprises a bottom wall disposed at a bottom edge of the side wall.

* * * * *